US007733226B2

(12) United States Patent
Richard

(10) Patent No.: US 7,733,226 B2
(45) Date of Patent: Jun. 8, 2010

(54) INFRARED INTRUSION DETECTION DEVICE

(75) Inventor: Matthieu Richard, Fourcatier (FR)

(73) Assignee: Robert Bosch GmbH, Stuttgart (DE)

( * ) Notice: Subject to any disclaimer, the term of this patent is extended or adjusted under 35 U.S.C. 154(b) by 304 days.

(21) Appl. No.: 12/065,149

(22) PCT Filed: Mar. 16, 2006

(86) PCT No.: PCT/EP2006/060807

§ 371 (c)(1),
(2), (4) Date: Feb. 28, 2008

(87) PCT Pub. No.: WO2007/104363

PCT Pub. Date: Sep. 20, 2007

(65) Prior Publication Data

US 2008/0198010 A1 Aug. 21, 2008

(51) Int. Cl.
*G08B 13/08* (2006.01)

(52) U.S. Cl. ..... 340/545.7; 340/541; 340/545.3; 340/565; 340/567; 250/338.1

(58) Field of Classification Search ..... 340/545.7, 340/545.3, 541, 565, 567, 522, 561; 250/338.1, 250/338.3, 339.11
See application file for complete search history.

(56) References Cited

U.S. PATENT DOCUMENTS 5,499,016 A 3/1996 Pantus
6,262,661 B1 7/2001 Mahler et al.
6,529,129 B1 * 3/2003 Tomooka ..... 340/556
6,642,846 B1 * 11/2003 Krubiner et al. ..... 340/545.3
7,079,028 B2 * 7/2006 Herrmann et al. ..... 340/541
7,265,670 B2 * 9/2007 Pantus et al. ..... 340/541
7,586,408 B1 * 9/2009 Mudge ..... 340/541

FOREIGN PATENT DOCUMENTS

EP 0 660 284 6/1995
EP 0 817 148 1/1998

* cited by examiner

*Primary Examiner*—Toan N Pham
(74) *Attorney, Agent, or Firm*—Michael J. Striker

(57) ABSTRACT

The invention relates to an infrared intrusion detection device. It comprises a housing 1, a window 2, which is arranged at a front side of the housing and which is transparent for at least infrared radiation emitted by an intruder, an infrared sensor arranged inside the housing for detecting the infrared radiation emitted by the intruder. Further it comprises a light guide 7, which is arranged inside the housing, which has at least one light entrance facet and which has a plurality of light exit facets 3 being arranged at the front side of the housing. A light emitter 6 is arranged inside the housing for injecting light into the at least one light entrance facet of the light guide. A light detector is provided for detecting light reflected back into the housing by an obstacle in the vicinity of the window. A signal processing unit is arranged for triggering an alarm, when an absolute difference of the intensity of back-reflected light to a predetermined value exceeds a threshold value.

6 Claims, 3 Drawing Sheets

INFRARED INTRUSION DETECTION DEVICE

CROSS-REFERENCE TO A RELATED APPLICATION

The invention described and claimed below is also described in PCT International Application Number PCT/EP2006/060807 filed on Mar. 16, 2005, whose subject matter is incorporated here by reference and which provides the basis for a claim of priority.

BACKGROUND OF THE INVENTION

The present invention relates to an infrared intrusion detection device, in particular to an infrared intrusion detection device capable of detecting a cover attack.

STATE OF THE ART

In order to prevent burglary in houses, infrared intrusion detection devices are commonly used. The infrared intrusion detection devices are using a sensor, which detects an appearance or movement of a source of any radiation in the far infrared range, i.e. of about 10 μm. The warm bodies of humans, vehicles, etc. are radiating in this emission range. An active infrared intrusion detection device triggers an alarm, when a human passes an observed area.

In daytime, the infrared intrusion detection devices are usually deactivated. In the meantime a burglar can cover the window by a sheet of paper or any other hard cover. The sheet of paper is opaque in the far infrared range. Thus the radiation of the burglar will be blocked before reaching the sensor of the intrusion detection system and no alarm is triggered. This obstruction of the intrusion detection device is known as cover attack. Several mechanisms have been considered that trigger an alarm in case of a cover attack.

EP 0 660 284 A1 describes an intruder detection system for sensing infrared emission radiated by an intruder. An infrared emitting diode is placed in front of an window of the intruder detection system and a near infrared detector behind the window. A sheet of paper slided into the optical path of the near infrared light causes a decrease of the signal of the light detector. Then an obstruction alarm is triggered. A sheet of paper approaching the near infrared light emitting diode will reflect parts of the near infrared light through the window. This causes an increase of the near infrared light detected by a detector. This triggers an alarm as well. But a cover attack can be effected by sliding a sheet of paper carefully along the window and starting at a side of the window opposing the near infrared light emitting diode and stopping before the sheet of paper crosses the optical path of the near infrared light. The sheet of paper will not be illuminated and no infrared light reflected to the infrared light detector. This cover attack doesn't render the intruder detection system completely dysfunctional, but reduces the angular area observed by the intruder detection system.

U.S. Pat. No. 5,499,016 discloses an intrusion alarm system, which has a near infrared light emitting diode illuminating the front side of an window. A corresponding light detector is arranged at the front side of the windows and measures the intensity of the infrared light scattered by the window. A cover attack can be effected with a sheet of paper that has the same reflective properties as the window.

SUMMARY OF THE INVENTION

The present invention provides an infrared intrusion detection device that effectively prevents a cover attack. Additionally, the set-up of the infrared intrusion detection device is simple and needs no complex optic elements.

The infrared intrusion detection device according to the invention comprises a housing, a window, which is arranged at a front side of the housing and which is transparent for at least infrared radiation emitted by an intruder, an infrared sensor arranged inside the housing for detecting the infrared radiation emitted by the intruder. Further it comprises a light guide, which is arranged inside the housing, which has at least one light entrance facet and which has a plurality of light exit facets being arranged at the front side of the housing. A light emitter is arranged inside the housing for injecting light into the at least one light entrance facet of the light guide. A light detector is provided for detecting light reflected back into the housing by an obstacle in the vicinity of the window. A signal processing unit is arranged for triggering an alarm, when an absolute difference of the intensity of back-reflected light to a predetermined value exceeds a threshold value. Light is emitted by each of the exit facets. A cover slided over the window or brought into vicinity of the window reflects a fraction of the light towards the sensor inside of the intrusion detection device. Then an alarm is triggered by the signal processing unit.

Advantageously, the light guide and its exit facets can be arranged easily inside the intrusion detection device. In particular a single light source is sufficient, which reduces the demands on electric wirings.

Further refinements and embodiments are given in the subclaims.

In one embodiment at least one of the light exit facets is arranged at each edge of the window. Thus a complete coverage of all sides of the window is achieved. Regardless from which direction a cover is approached to window, an obstruction alarm will be triggered.

The light guide can comprise a bundle of glass fibres and the light guide can have a small aperture. A small aperture leads to a strongly diverging light cone. Thus a good coverage of the area around the window is possible with just a few exit facets. The wavelength of the light used by the light emitter and the light detector can be in the near infrared range.

According to an embodiment at least one of the exits is arranged to emit light towards the window. The light is scattered by the window and in part of the light is directed to the detector. Spray applied to the exit facets changes the amount of light emitted to the window. Further in case a spray is applied to the window the quality of the scattering property of the window is altered. In both cases a different amount of the near infrared light is scattered towards the light sensor. A double threshold means detects the change and triggers an alarm.

The present invention is exemplarily described by preferred embodiments and figures.

DESCRIPTION OF THE PREFERRED EMBODIMENTS

Figure 1:
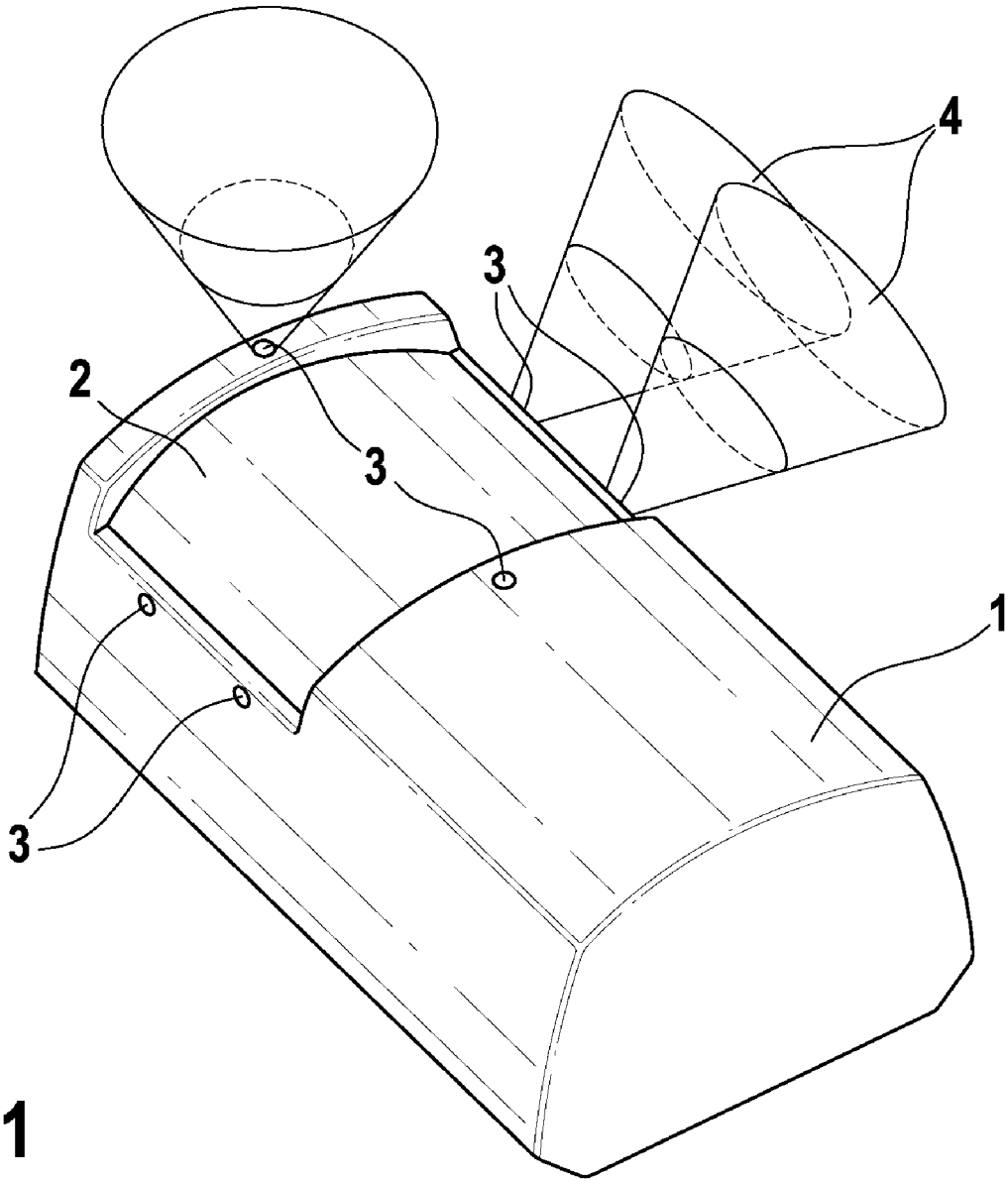
FIG. 1 shows one embodiment of the present invention.

FIG. 1 shows one embodiment of an infrared intrusion detection device. A housing 1 is provided with a window 2. A passive infrared sensor is arranged behind the window 2. This infrared sensor is sensitive for radiation in the far infrared range, i.e. for a radiation having a wavelength of about 10 μm. A person or any warm body emits radiation in this wavelength range. Thus, a person passing by causes an increase and/or decrease of the intensity of radiation measured by the far infrared sensor. Then an intrusion alarm is activated.

An obstruction of the infrared intrusion detection device can be effected by placing a sheet of paper in front of the window 2. This sheet of paper is opaque at 10 μm. The optical path from an intruder to the infrared sensor is blocked, and the infrared intrusion detection device becomes virtually blind.

In this embodiment light emitting spots 3 are arranged around the window 2. They are radially emitting light 4. Advantageously, the cones of the emitted light are overlapping. In case a sheet of paper is in the vicinity of the window, the sheet of paper will reflect and diffuse the emitted light back towards the window 2. A corresponding light detector is arranged behind the window and inside the housing 1. This light detector detects an increase due to the reflected light. Then, an obstruction alarm is triggered.

Figure 2:
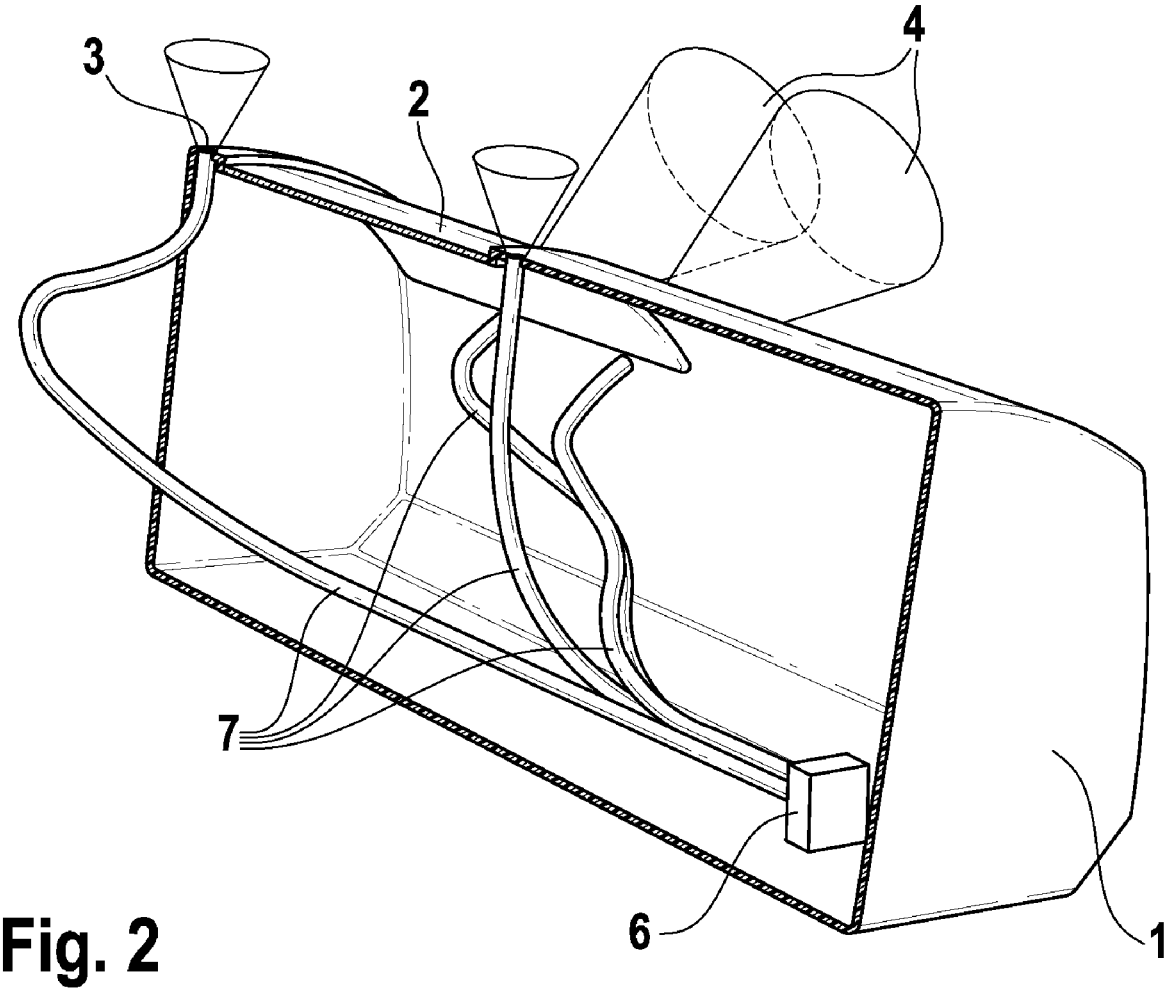
FIG. 2 is a sectional view of the embodiment of FIG. 1.

FIG. 2 illustrates the optical set-up inside the housing 1. A single light source 6 is placed inside the housing 1. This light source 6 is connected to a bundle of fibres 7. Advantageously, the fibres are made of a plastic material. They may be manufactured without a cladding. The light exit facets 3 of the fibres 7 are forming the light spots 3. In case the angular distribution of the light 4 needs to be broadened a diffuser is placed at the exit facets 3.

Fibres 7 are very flexible in use and arrangement. They can be easily arranged inside the housing 1 according to the designer's needs. The number of light exit facets 3 can be easily increased by using more fibres 7. Thus, almost a complete coverage of the circumference of the window 2 is achieved easily. An obstruction of the window 2 by sliding a sheet of paper over the window 2 is almost rendered impossible. The sheet of paper will cross at least one light cone 4 and reflects a fraction of this light cone towards the light detector arranged behind the window and thus triggers an obstruction alarm.

The light source 6 can be a near infrared light emitting diode. The light detector is placed inside the housing 1 and is sensitive to the light emitted by the light source 6.

Figure 3:
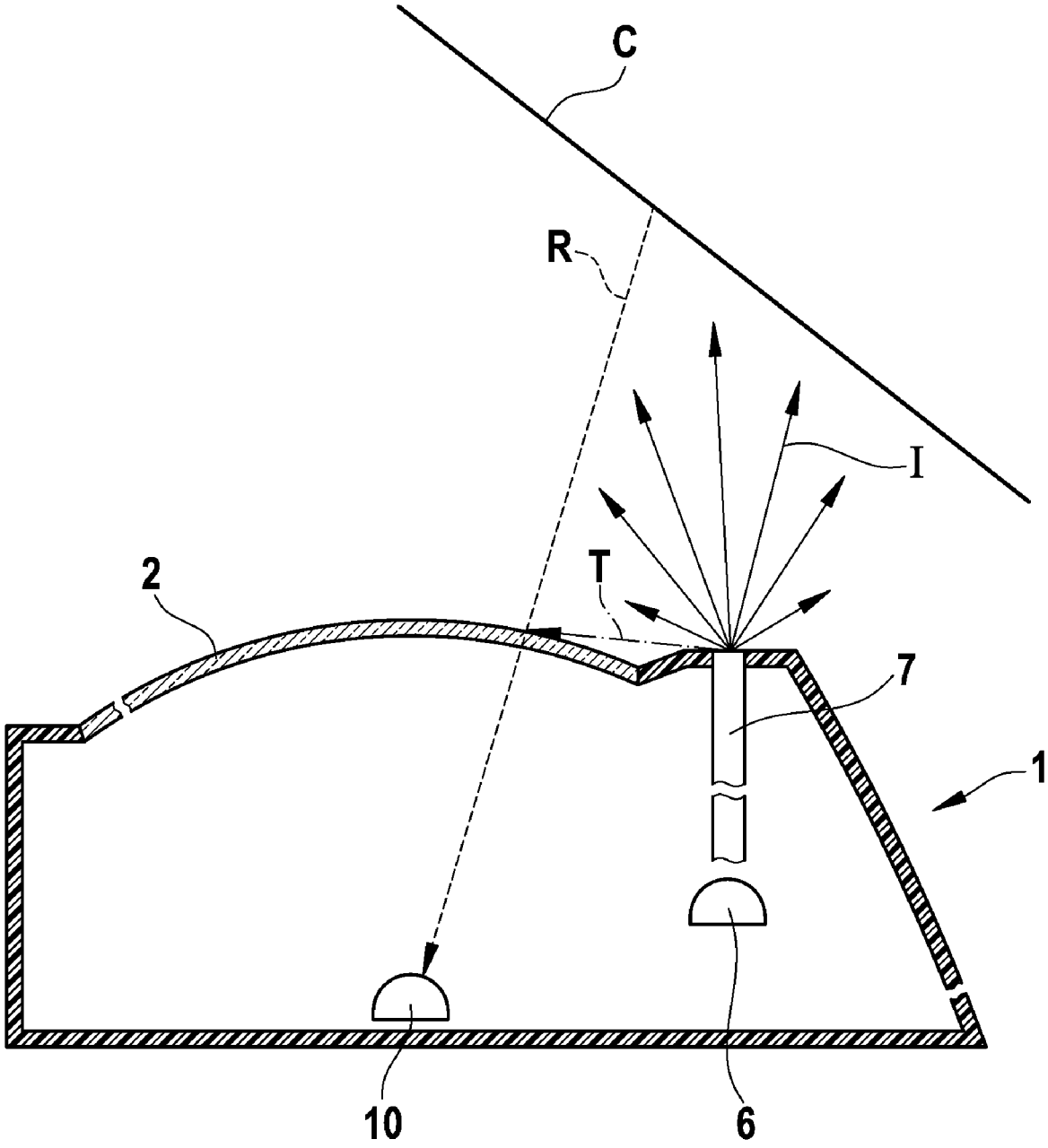
FIG. 3 is a schematic illustration for illustrating an underlying principle of the invention.

FIG. 3 illustrates underlying principles of the invention. The light of the light emitting diode 6 is injected into a light guide 7 or glass fibre. At the exit facet of the light guide 7, the light is emitted in almost any directions. Most of the light, however, will be emitted within a cone 4. A part of the light I will be reflected at a sheet of paper C. The surface of the cover C is diffusive. Thus, at least a part of the reflected light R is directed towards an infrared sensor 10. A discriminator detects the increase of the detector's 10 signal and triggers an obstruction alarm.

A saboteur could cover the exit facets 3, for example by carefully placing small stripes over the exit facets 3. Thus they 3 cannot emit light. Afterwards a larger cover may be placed over the window 2 or an opaque spray be applied to the window 2 without triggering an alarm.

The exit facets 3, however, may be arranged such that at least a part of the light T, which is emitted by the exit facets 3, is directed towards the window 2. The window 2 scatters the light T. A part of the light T hits the detector. The signal of the detector 10 is compared to a lower threshold, as well. An obstruction alarm is triggered when the signal falls below this lower threshold value. The stripes, therefore, cause an alarm.

The invention claimed is:

1. An infrared intrusion detection device, comprising a housing (1), a window (2), which is arranged at a front side of the housing (1) and which is transparent for at least infrared radiation emitted by an intruder, an infrared sensor arranged inside the housing (1) for detecting the infrared radiation emitted by the intruder, a light guide (7), which is arranged inside the housing (1), which has at least one light entrance facet and which has a plurality of light exit facets (3) arranged at the front side of the housing (1), a light emitter (6) inside the housing (1) for injecting light into the at least one light entrance facet of the light guide (7), a light detector for detecting light reflected back into the housing by an obstacle in the vicinity of the window (2), and a signal processing unit for triggering an alarm, when an absolute difference of the intensity of back-reflected light to a predetermined value exceeds a threshold value.

2. The infrared intrusion detection device as defined in claim 1, wherein at least one of the light exit facets (3) is arranged at each edge of the window (2).

3. The infrared intrusion detection device as defined in claim 1, wherein the light guide (7) comprises a bundle of glass fibres.

4. The infrared intrusion detection device as defined in claim 1, wherein the light guide (7) has a large numerical aperture index.

5. The infrared intrusion detection device as defined in claim 1, wherein the wavelength of the light used by the light emitter, the light detector is in the near infrared range and the window is translucid in the near infrared range.

6. The infrared intrusion detection device as defined in claim 1, wherein at least one of the exits facets is arranged to emit light towards the window.

* * * * *